US010894631B2

(12) United States Patent
Reinhart et al.

(10) Patent No.: US 10,894,631 B2
(45) Date of Patent: Jan. 19, 2021

(54) FOLDABLE CRATE

(71) Applicant: CREATIVE PLASTIC CONCEPTS, LLC, Sycamore, OH (US)

(72) Inventors: Nickolas Reinhart, Findlay, OH (US); Jacob H. Whitta, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 49 days.

(21) Appl. No.: 16/368,915

(22) Filed: Mar. 29, 2019

(65) Prior Publication Data

US 2019/0300239 A1 Oct. 3, 2019

Related U.S. Application Data

(60) Provisional application No. 62/651,094, filed on Mar. 31, 2018.

(51) Int. Cl.

| | |
|---|---|
| ***B65D 21/08*** | (2006.01) |
| ***B65D 25/30*** | (2006.01) |
| ***B65D 21/02*** | (2006.01) |

(52) U.S. Cl.

CPC ..... *B65D 21/086* (2013.01); *B65D 21/0209* (2013.01); *B65D 25/30* (2013.01)

(58) Field of Classification Search

CPC .... B65D 88/522; B65D 88/22; B65D 21/086; B65D 21/0209; B65D 21/02; B65D 7/30; B65D 7/24; B65D 11/1833; B65D 11/18; B65D 11/20; B65D 25/30; B65D 25/28

USPC ..... 220/7, 6, 4.33, 4.28, 770, 756; 206/600

See application file for complete search history.

(56) References Cited

U.S. PATENT DOCUMENTS

| | | | | |
|---|---|---|---|---|
| D228,881 | S | 10/1973 | Stauble | |
| D355,073 | S | 2/1995 | Junaedi | |
| D370,344 | S | 6/1996 | Kim | |
| D379,718 | S | 6/1997 | Raghunathan | |
| D381,513 | S | 7/1997 | Brauner | |
| D387,557 | S | 12/1997 | Provot | |
| D423,217 | S | 4/2000 | Varfeldt | |
| D446,392 | S | 8/2001 | Overholt | |
| 6,290,081 | B1 * | 9/2001 | Merey | B65D 11/1833 220/7 |
| D614,403 | S | 4/2010 | Byron | |
| D663,121 | S | 7/2012 | Barth | |
| D670,081 | S | 11/2012 | Orgeldinger | |
| D797,453 | S | 9/2017 | Shamp | |
| D801,686 | S | 11/2017 | Park | |
| D801,687 | S | 11/2017 | Holland | |
| D801,688 | S | 11/2017 | Holland | |

(Continued)

*Primary Examiner* — Robert J Hicks

(74) *Attorney, Agent, or Firm* — Jacob M. Ward; Ward Law Office LLC

(57) ABSTRACT

A foldable crate includes a bottom panel, left and right side panels, and front and rear panels. The various panels are movable between an unfolded position and a folded position. Latching mechanisms are used to selectively secure the panels where in the unfolded position. The latching mechanisms have handles that allow them to be manually actuated by a user between an engaged position and a disengaged position. The latching mechanisms are also used to selectively disengage the panels to allow them to move to the folded position. The latching mechanism may be installed in recesses or side openings of the left and right side panels and slidably secured by clips above and below the recesses.

20 Claims, 9 Drawing Sheets

(56) References Cited

U.S. PATENT DOCUMENTS

| | | | | |
|---|---|---|---|---|
| D802,926 | S | 11/2017 | Turner | |
| D816,997 | S | 5/2018 | Turner | |
| 2003/0000950 | A1* | 1/2003 | Murakami | B65D 11/1833 220/6 |
| 2010/0294757 | A1* | 11/2010 | Pils | B65D 11/1833 220/7 |
| 2014/0083896 | A1 | 3/2014 | Park | |
| 2014/0144909 | A1* | 5/2014 | Bobritski | B65D 25/30 220/7 |
| 2017/0137175 | A1 | 5/2017 | Park | |

* cited by examiner

FOLDABLE CRATE

CROSS-REFERENCE TO RELATED APPLICATIONS

This application claims the benefit of U.S. Provisional Application No. 62/651,094, filed on Mar. 31, 2018. The entire disclosure of the above application is hereby incorporated herein by reference.

FIELD

The disclosure generally relates to a crate and, more particularly, to a foldable crate.

BACKGROUND

Typically, known crates have a horizontally oriented bottom panel with four vertically oriented side panels. Material loaded within the crate is safely stored or shipped from place to place as needed.

Unfortunately, when crates are stored or shipped about, while being empty, much floor space and vertical space is consumed by the overall volume of the empty crate. This is especially true for shipping empty crates within a semi-tractor trailer or stacking them in a warehouse.

There is a continuing need for crates that are foldable to conserve floor and vertical space when empty.

SUMMARY

In concordance with the instant disclosure, a foldable crate that conserves floor and vertical space when empty, has been surprisingly discovered.

A foldable crate includes a bottom panel, a left side panel, a right side panel, a front panel, and a rear panel. The bottom panel is hingedly attached at four edges to lower edges of the left side panel, the right side panel, the front panel, and the rear panel.

Where oriented into a vertical or unfolded position, each of the side panels is capable of being interlocked with the front and rear panels via latching mechanisms. Specifically, the right edge of the front panel is capable of being selectively interlocked with the front edge of the right panel, the left edge of the front panel is capable of being selectively interlocked with the front edge of the left panel, the right edge of the rear panel is capable of being selectively interlocked with the rear edge of the right panel, and the left edge of the rear panel is capable of being selectively interlocked with the rear edge of the left panel.

Where the crate is empty, and a user has decided to fold the crate to a horizontal or folded position to conserve space or volume, there are two separate latching mechanisms on each of the right and left side panels which can be grasped by the user to release the side panels from the front and rear panels. Thereby, the right side panel can be caused to horizontally rest on the top of the bottom panel and the left side panel can be caused to horizontally rest on the top of the right side panel. Subsequently, a center portion of each of the front and rear panels may also be caused to rest on approximately the exterior surface of the last side panel to be lowered to the folded position. It should be appreciated that, in the folded position, the front and rear panels may also not touch each other. As a result of this movement of the side panels, the front panel, and the rear panel, the foldable crate may be placed in a completely folded position for storage or transport.

The latching mechanisms of the present disclosure are configured to selectively secure and release the side panels for unfolding, to store and ship contents, and for folding to rest on the front, right, and bottom panel in a folded position. A first mechanism of the disclosure is molded within the side panels and uses a first latch with two slide extensions installed within an interior side channel space. The slide extensions have a groove that makes securing interlocked contact with a post on the corners of the front or rear panels. A second mechanism of the disclosure is installed in the side panels behind exterior angled clips, and is used for interlocking with corner posts. A third and preferred mechanism has a unitary slide extension that is installed by being snapped through exterior openings between flat and beveled clips, for securing and releasing interlocked front or rear panels. Squeezing a handle in any of the these three latching mechanism embodiments is adapted to release the side panels for folding to the folded position.

In one embodiment, a foldable crate includes a bottom panel, a left side panel, a right side panel, a front panel, and a rear panel. Each of the left side panel, the right side panel, the front panel, and the rear panel are hingedly attached to the bottom panel and movable between a folded position and an unfolded position. The foldable crate also includes at least one latching mechanism. The latching mechanism is disposed in one of the left side panel and the right side panel. The latching mechanism is configured to be manually moved from an engaged position to a disengaged position. In the engaged position, the latching mechanism is configured to selectively interlock one of the left side panel and the right side panel with one of the front panel and the rear panel where one of the left side panel and the right side panel are in the unfolded position.

In particular, the latching mechanism includes a main body having a handle with a spring and at least one slide extension with an end portion. The spring contacts an area of one of the left side panel and the right side panel and normally biases the latching mechanism in the engaged position. The spring is further permitted to be manually compressed upon movement of the latching mechanism to the disengaged position. The end portion of the at least one slide extension is configured to selectively interact with one of the front panel and the rear panel where the one of the left side panel and the right side panel are in the unfolded position and the latching mechanism is in the engaged position.

In certain embodiments, the at least one slide extension includes a single, one-piece slide extension. The end portion of the single, one piece slide extension may also be blunt and not cup-shaped as in alternate embodiments. In this case, each of the front panel and the rear panel has corners, and each of the corners includes a recess disposed between a pair or parallel ribs. The recess is configured to receive the blunt end of the at least one slide extension where in the engaged position and to not receive the blunt end of the at least one slide extension in the disengaged position. One of the left side panel and the right side panel is also interlocked with one of the front panel and the rear panel where the left side panel, the right side panel, the front panel, and the rear panel are in the unfolded position and the blunt end of the latching mechanism is in the engaged position.

In a most particular embodiment, the at least one latching mechanism includes a first pair of latching mechanisms and a second pair of latching mechanisms. The first pair of latching mechanisms may be oriented in opposite directions relative to each other within the left side panel. The second pair of latching mechanisms may be oriented in opposite directions relative to each other within the right side panel. In this configuration, a user can disengage the left side panel from the front and rear panels by gripping both handles of the first pair of latching mechanisms between the thumb and fingers of a single hand and squeezing the handles toward each other. Likewise, in this configuration, a user can disengage the right side panel from the front and rear panels by gripping both handles of the second pair of latching mechanisms between the thumb and fingers of a single hand and squeezing the handles toward each other Each of the left side panel and the right side panel may have exterior and interior ribs formed thereon. These ribs may support and strengthen the left side panel and the right side panel.

In an exemplary embodiment, an outer surface of one of the left side panel and the right side panel has a recess formed therein that receives the latching mechanism. A perimeter of the recess has a plurality of clips configured to slidably secure the latching mechanism within the recess. The clips may include a plurality of upper clips and a plurality of lower clips. The upper clips are spaced apart from the lower clips. Each of the upper clips and the lower clips may include flat clips and beveled clips. The flat clips and the beveled clips may be arranged in an alternating fashion along the perimeter of the recess. Each of the beveled clips may also have a beveled outer surface. The beveled outer surface permits for the latching mechanism to be snapped into the recess past the beveled clips during an installation of the latching mechanism. The spring is disposed on a first side of the handle and the at least one slide extension is disposed on a second side of the handle. The first side is disposed opposite the second side.

The spring, the handle, and the at least one slide extensions may also be formed as a single, one-piece unit. The single, one-piece unit may be molded plastic, for example. The spring may be defined by a tab extending outwardly from the handle and oriented an angle relative to a bottom surface of the handle. The handle may be defined by a hand-sized cup element disposed between the spring and the at least one slide extension.

In an alternative embodiment, the end portion of the slide extension may have a cup and one of the front panel and the rear panel may have a post. The cup is configured to receive the post where the latching mechanism is in the engaged position and the one of the front panel and the rear panel is in the unfolded position.

DRAWINGS

The above, as well as other advantages of the present disclosure, will become readily apparent to those skilled in the art from the following detailed description, particularly when considered in light of the drawings described hereafter. It is to be noted that a bottom plan view of a folded crate is not shown because it would be the same as a bottom plan view of the unfolded crate, which is illustrated in FIG. 6.

Figure 21:
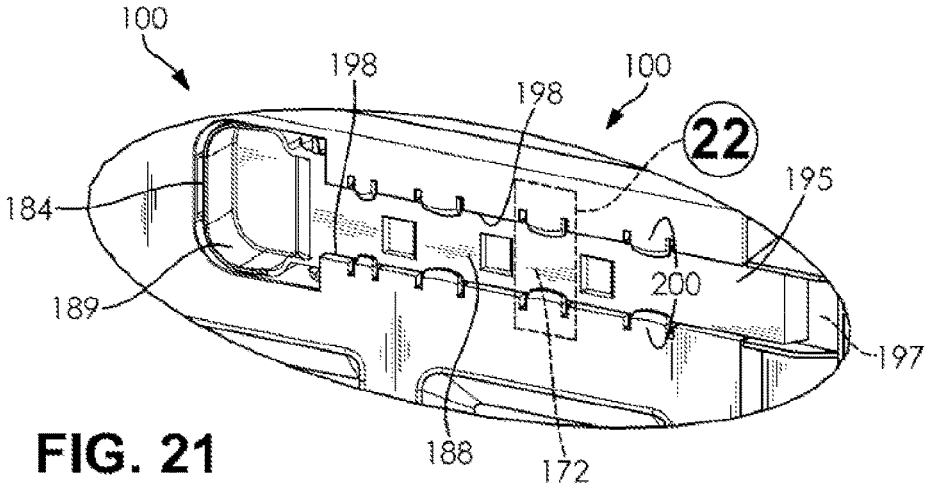
FIG. 21 is an enlarged fragmentary side perspective view of a foldable crate shown according to yet another embodiment of the disclosure, and showing a third embodiment of a latching mechanism disposed therein.
Figure 23:
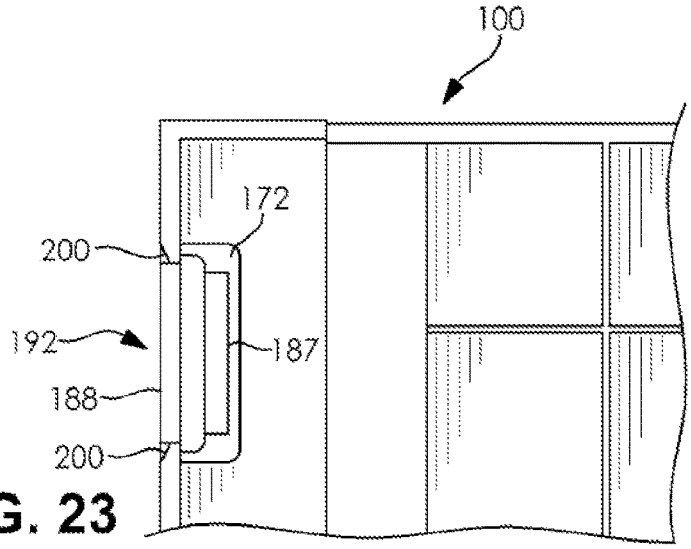
Figure 24:
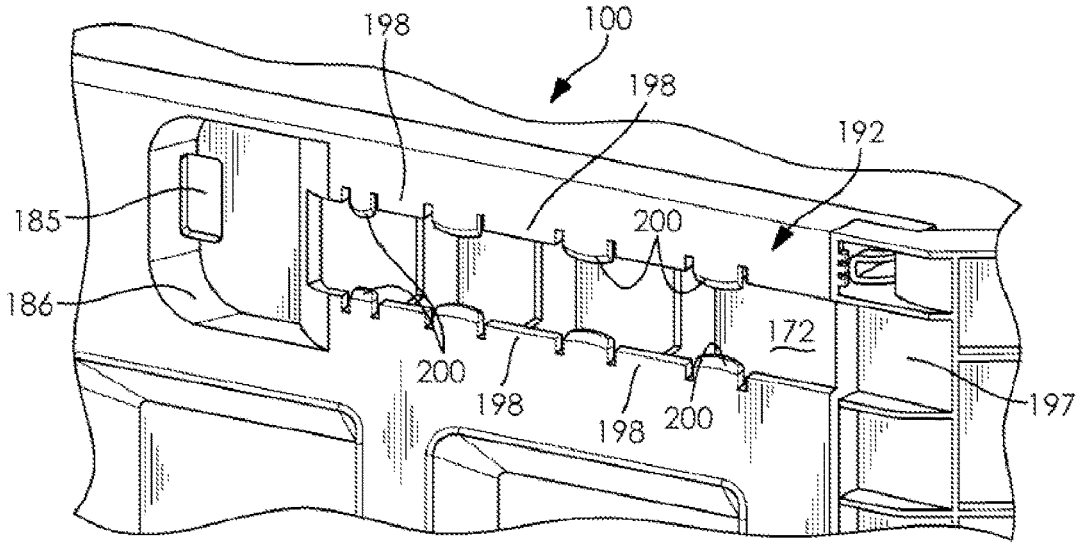

FIG. 23 is an enlarged fragmentary front elevational view of the foldable crate taken at call out 22 in FIG. 21, and showing the latching mechanism in a second position of a method of inserting the latching mechanism into the foldable crate; and FIG. 24 is an enlarged fragmentary side perspective view of the foldable crate shown in FIG. 21, illustrated without the latching mechanism and showing side panel clips for holding the latching mechanism in place upon insertion.

DETAILED DESCRIPTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

Figure 1:
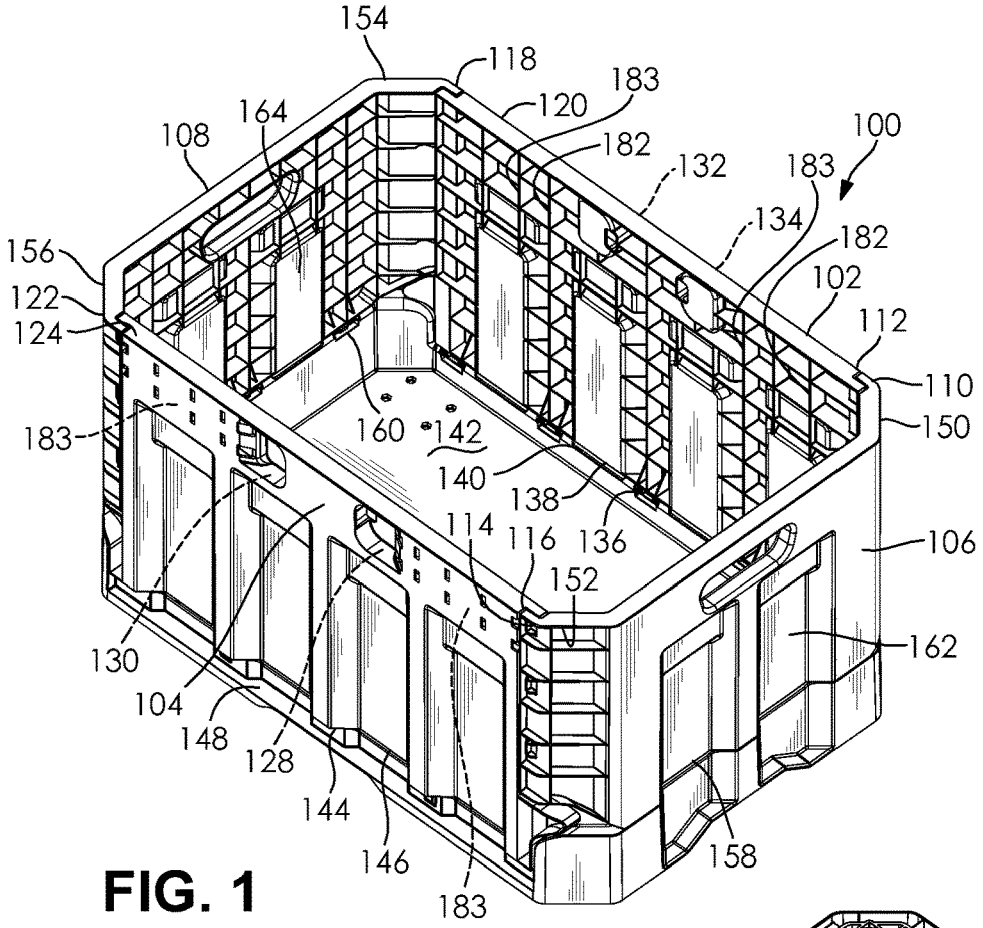
FIG. 1 is a top perspective view of a foldable crate according to one embodiment of the present disclosure, and showing the foldable crate in an unfolded position.
Figure 2:
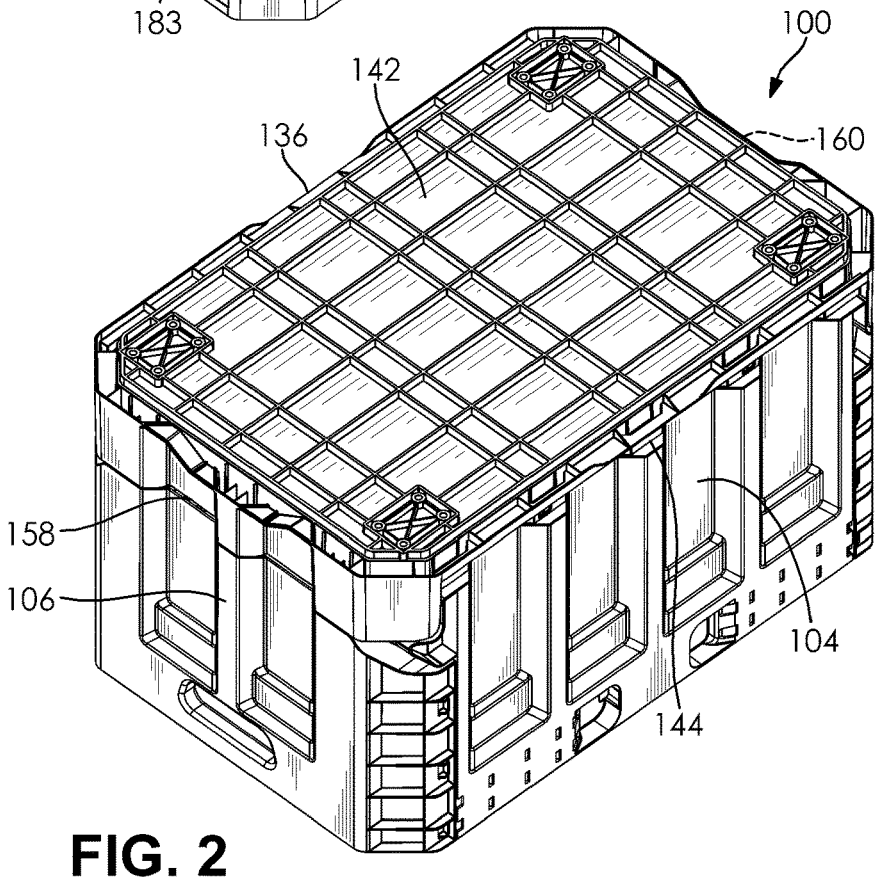
FIG. 2 is a bottom perspective view of the foldable crate shown in FIG. 1.
Figure 3:
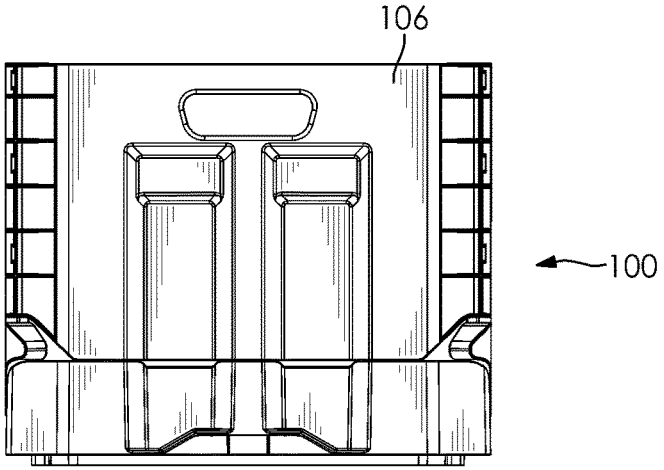
FIG. 3 is a front elevational view of the foldable crate shown in FIG. 1.
Figure 4:
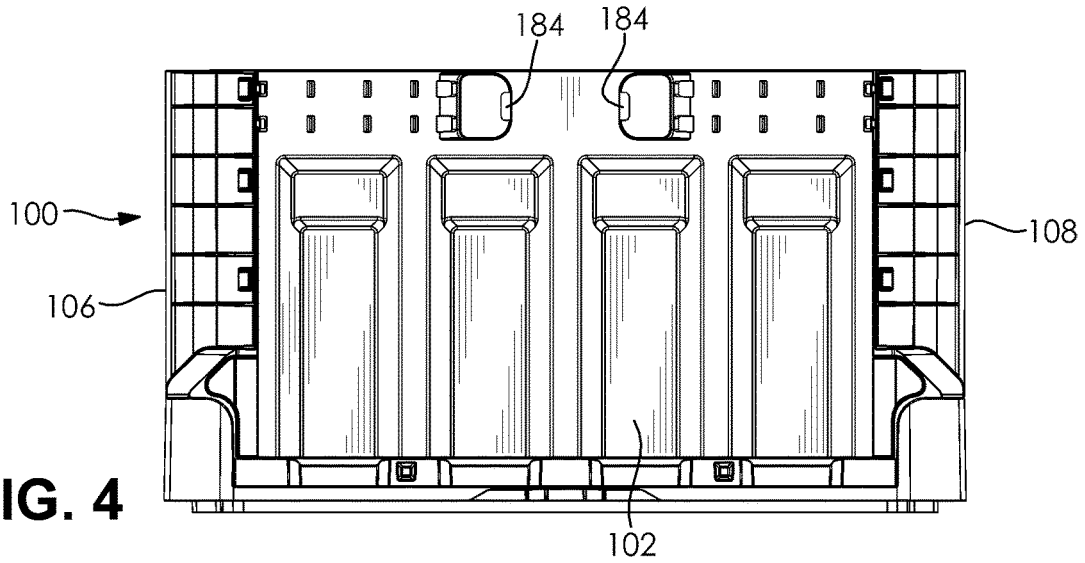
FIG. 4 is a right side elevational view of the foldable crate shown in FIG. 1.
Figure 5:
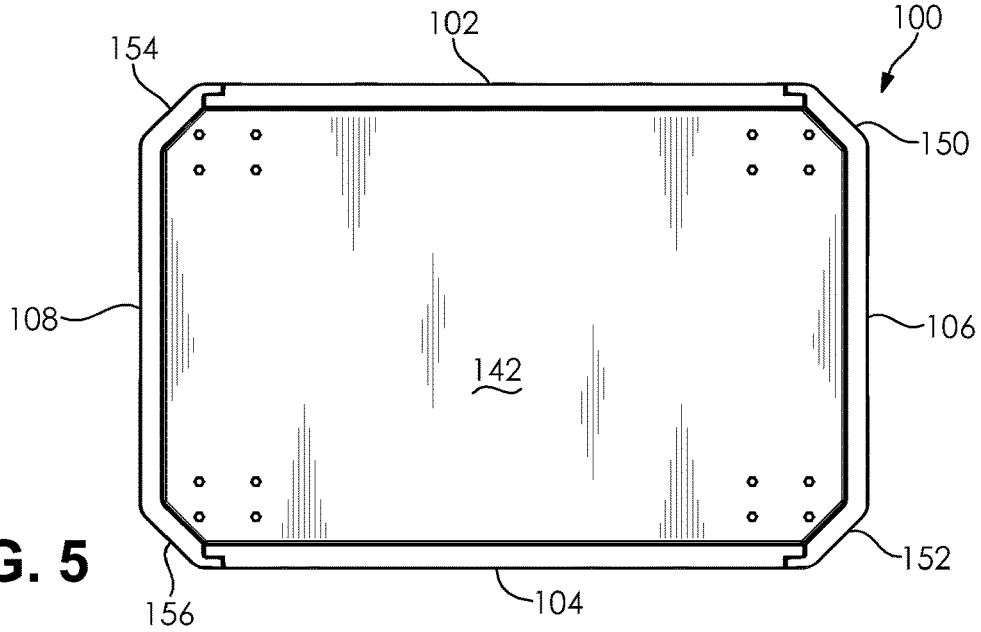
FIG. 5 is a top plan view of the foldable crated shown in FIG. 1.
Figure 6:
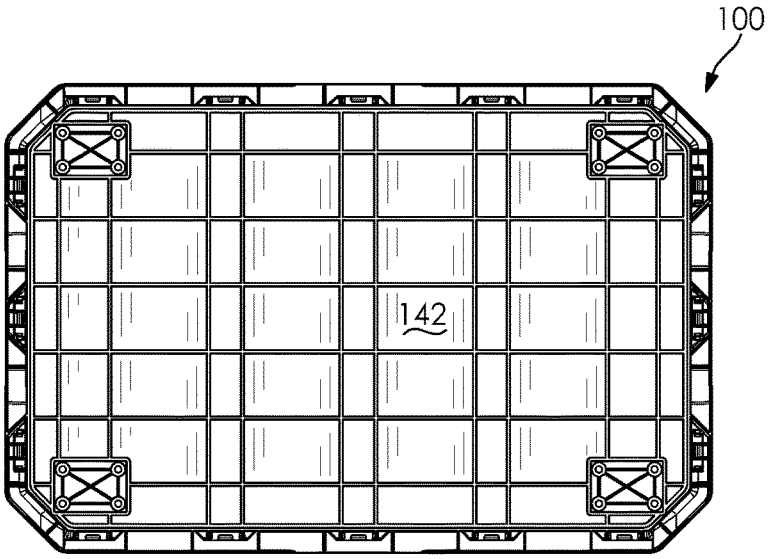
FIG. 6 is a bottom plan view of the foldable crate shown in FIG. 1.
Figure 7:
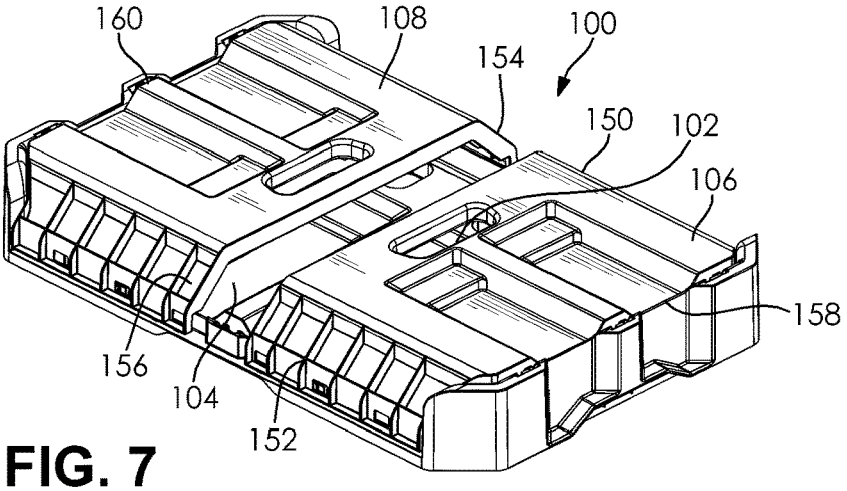
FIG. 7 is a top perspective view of the foldable crate shown in FIG. 1, and showing the foldable crate in a folded position.
Figure 8:
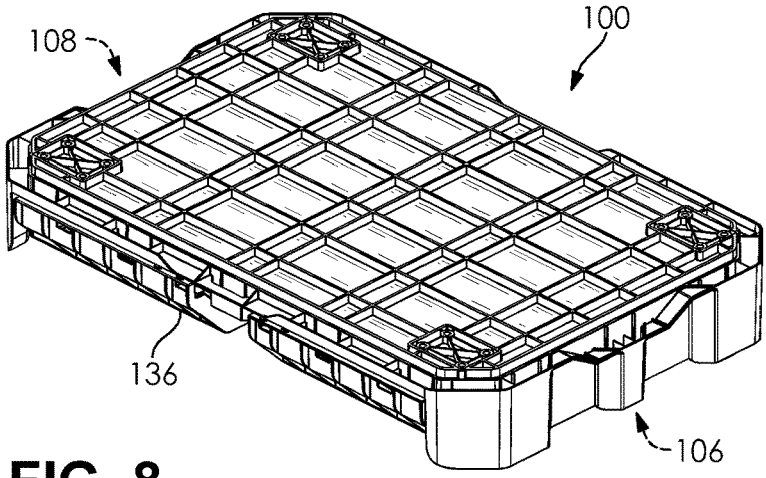
FIG. 8 is a bottom perspective view of the foldable crate shown in FIG. 7.
Figure 9:
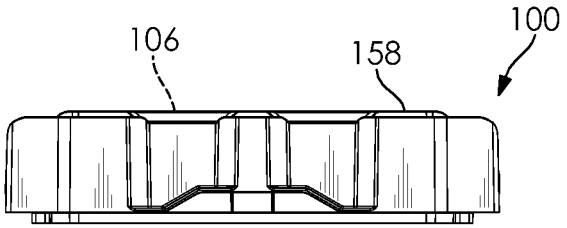
FIG. 9 is a front elevational view of the foldable crate shown in FIG. 7.
Figure 10:
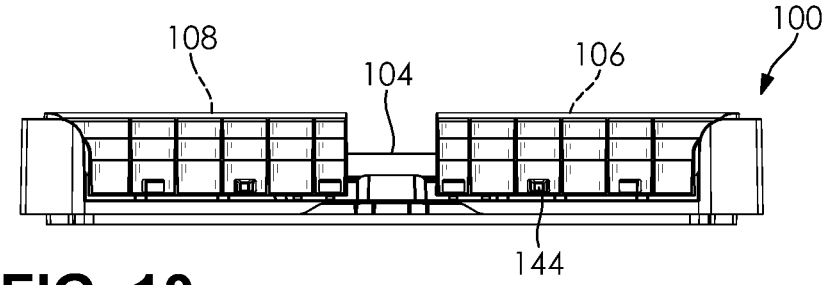
FIG. 10 is a left side elevational view of the foldable crate shown in FIG. 7.
Figure 11:
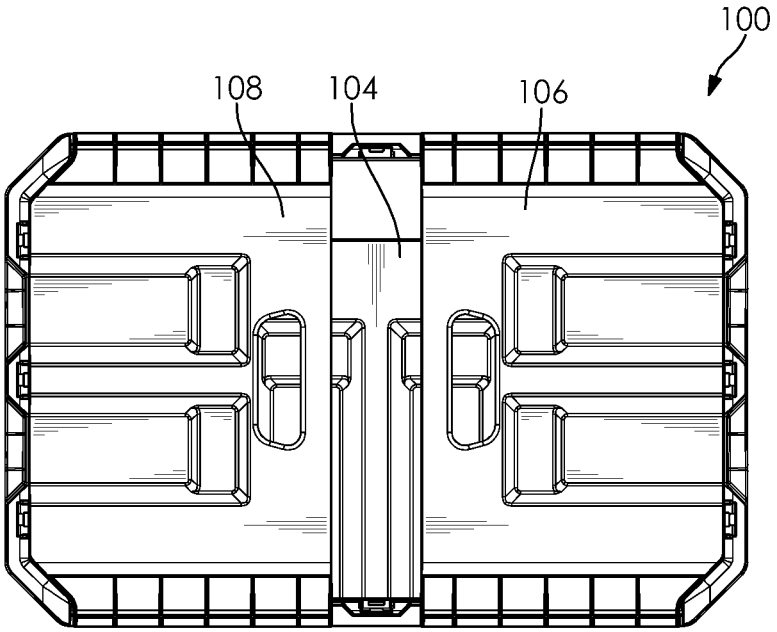
FIG. 11 is a top plan view of the foldable crate shown in FIG. 7.

A foldable crate 100 according to a first embodiment is illustrated in an unfolded position in FIG. 1. The foldable crate 100 has side panels 102, 104, a front panel 106, and a rear panel 108. Each of the side panels 102, 104 is interlocked with the corresponding mating front and rear panels 106, 108. Specifically, a right edge 110 of the front panel 106 is vertically interlocked with a front edge 112 of the right panel 102. A left edge 114 of the front panel 106 is vertically interlocked with a front edge 116 of the left panel 104. A right edge 118 of the rear panel 108 is vertically interlocked with a rear edge 120 of the right panel 102 A left edge 122 of the rear panel 108 is vertically interlocked with a rear edge 124 of the left panel 104.

Figure 12:
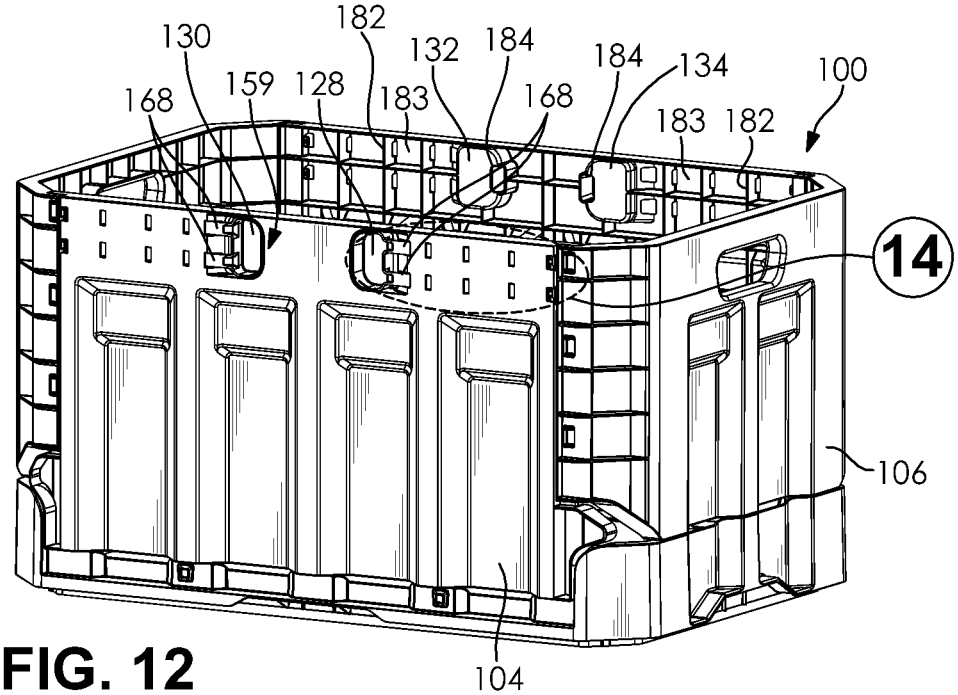
FIG. 12 is a top perspective side view of the foldable crate shown in FIG. 1, and showing a first embodiment of a latching mechanism disposed therein.
Figure 13:
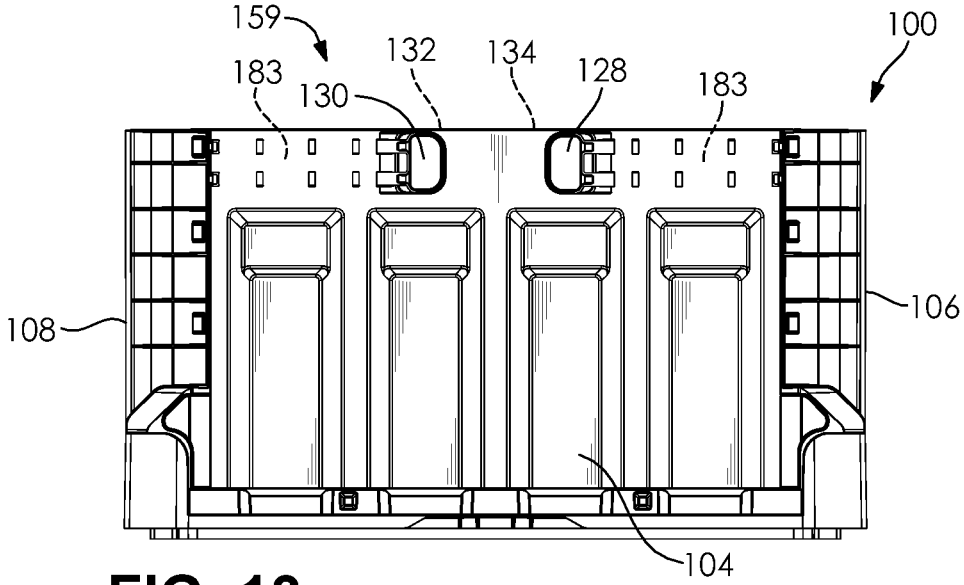
FIG. 13 is a left side elevational view of the foldable crate shown in FIG. 12.
Figure 17:
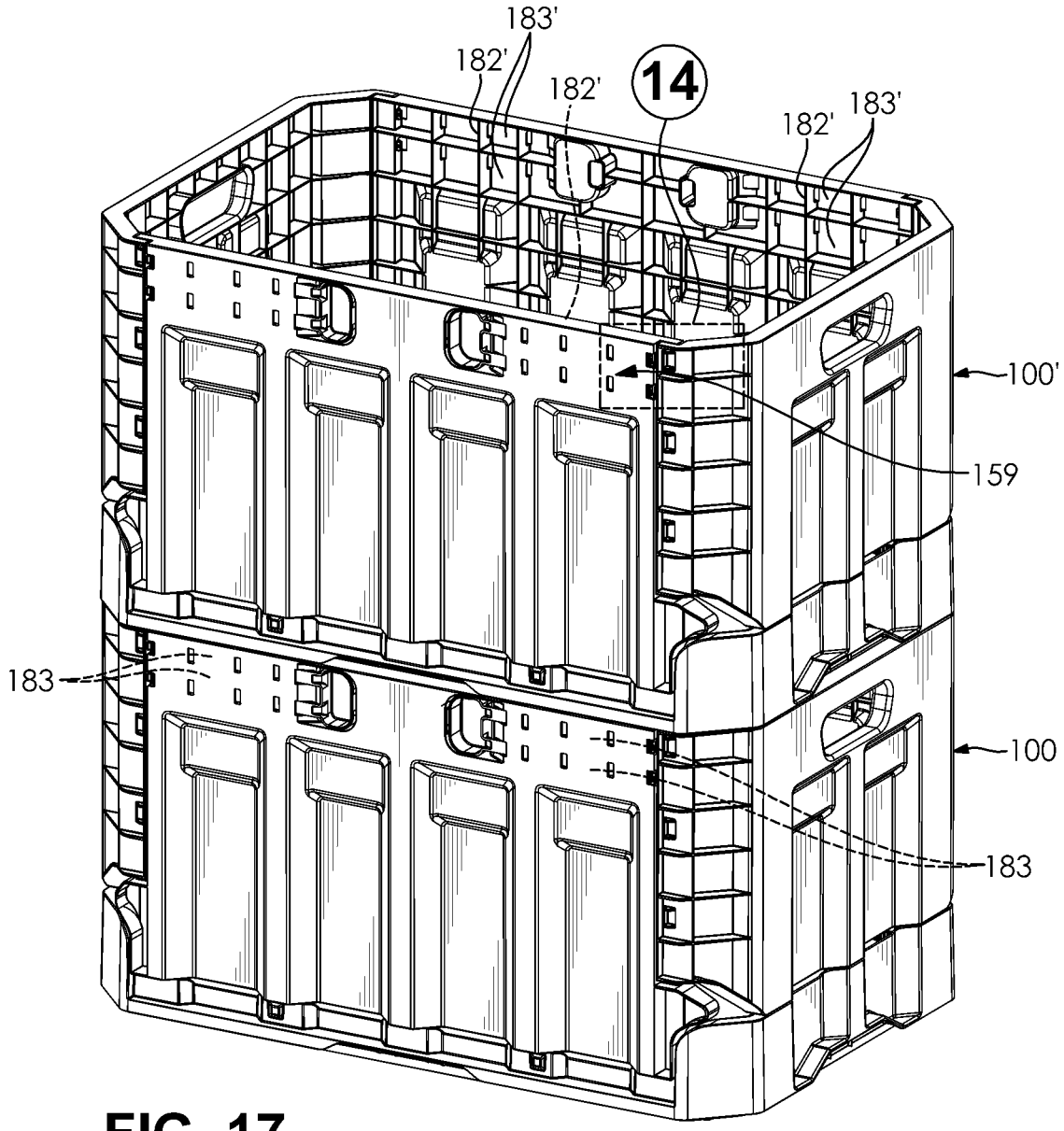
FIG. 17 is a top perspective view of a stacked pair of the foldable crates shown in FIG. 1, and further showing the foldable crates in the unfolded position and stacked together.

A pair of the foldable crates 100, 100' are shown both in the unfolded position and stacked, in FIG. 17, for storage or for transportation. It should also be appreciated that the foldable crates 100, 100' may be folded to a folded position, for example, as shown in FIGS. 7-11.

Where the foldable crate 100 is unfolded to the unfolded position, two sets of latching mechanisms 128, 130, 132, 134 may be employed to selectively hold the foldable create in the unfolded position, as illustrated in FIGS. 12-13. A first set of the latching mechanisms 128, 130 and a second set of the latching mechanisms 132, 134 are disposed on the right side panel 102 and on the left side panel 104, respectively. The latching mechanisms 128, 130, 132, 134 can be clasped by the user in order to selectively secure and release the side panels 102, 104 from the front and rear panels 106, 108, to thereby move the side panels 102, 104 between the folded and unfolded positions.

In operation, and with reference to FIGS. 1-16, although a selection of which of the side panels 102, 104 is lowered first may be arbitrary, for purposes of illustration the user might choose to first disengage the right latching mechanisms 132, 134. This disengagement releases the right side panel 102 from the front and rear panels 106, 108. As a result, the right side panel 102 may pivot downwardly, by way of a right side hinge 136, to rest on the bottom panel 142. The right side hinge 136 is located between the bottom edge 138 of the right side panel 102 and the right edge 140 of the bottom panel 142, for example, as shown in FIG. 1.

Subsequently, in operation, the left side panel 104 may be permitted to be lowered by way of disengaging the left latching mechanisms 128, 130. This disengagement releases the left side panel 104 from the front panel 106 and the rear panel 108. As a result, the left side panel 104 may pivot downwardly, by way of a left side hinge 144, to rest on top of the right side panel 102 previously lowered. The left side hinge 144 is located between the bottom edge 146 of the left side panel 104 and the left edge 148 of the bottom panel 142, as shown in FIG. 1.

In particular embodiments, the front panel 106 may have a set of corners 150, 152 and the rear panel 108 may have a set of corners 154, 156. The corners 150, 152, 154, 156 may be angled, for example, as shown in FIG. 1. The angling of the corners 150, 152, 154, 156 may militate against the front panel 106 and the rear panel 108 being lowered to the folded position before the side panels 102, 104. Then, where either the front panel 106 or the rear panel 108 have been lowered to the folded position by pivoting toward the bottom panel 142, by way of their respective hinges 158, 160, then center portions 162, 164 of respective front and rear panels 106, 108 may rest on an exterior surface 159 of the left panel 104. Thereby, the front and rear panels 106, 108 may not contact each other where the foldable crate 100 is fully collapsed into the folded position, which further conserves vertical space or volume.

The latching mechanisms 128, 130, 132, 134 according to a first embodiment of the disclosure are illustrated in FIGS. 12-16. These particular latching mechanisms 128, 130, 132, 134 may be preinstalled within the left and right panels 102, 104 of the foldable crate 100, for example, during a molding operation. In particular, a wall of each of the left and right side panels 102, 104 may have internal ribs 182 that define channel spaces 183 therein, as shown in FIG. 12. The internal ribs 182 may serve to support and stabilize the wall of each of the left and right side panels 102, 104.

Figure 14:
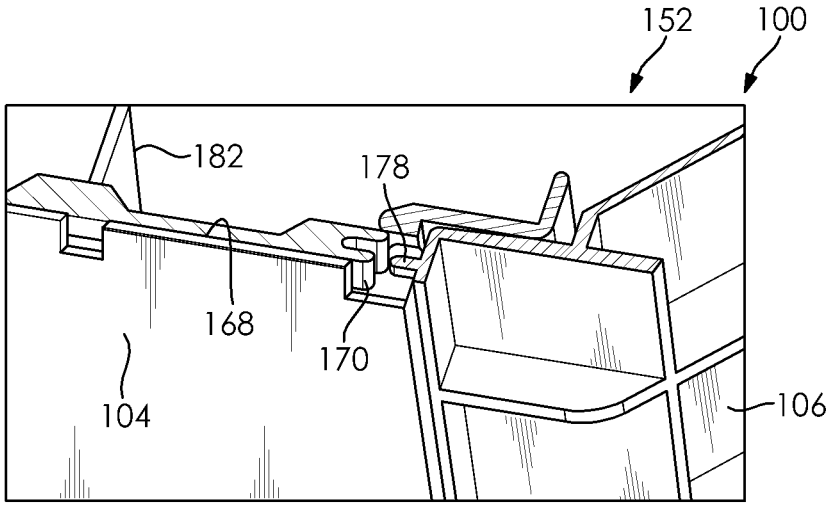
FIG. 14 is an enlarged fragmentary side perspective view taken at call out 14 in FIG. 12.
Figure 15:
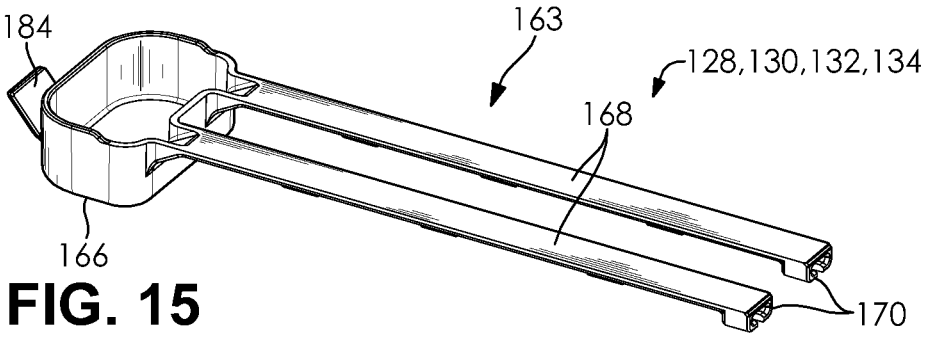
FIG. 15 is a top perspective view of a latch for the foldable crate shown in FIG. 12 according to one embodiment of the disclosure.
Figure 16:
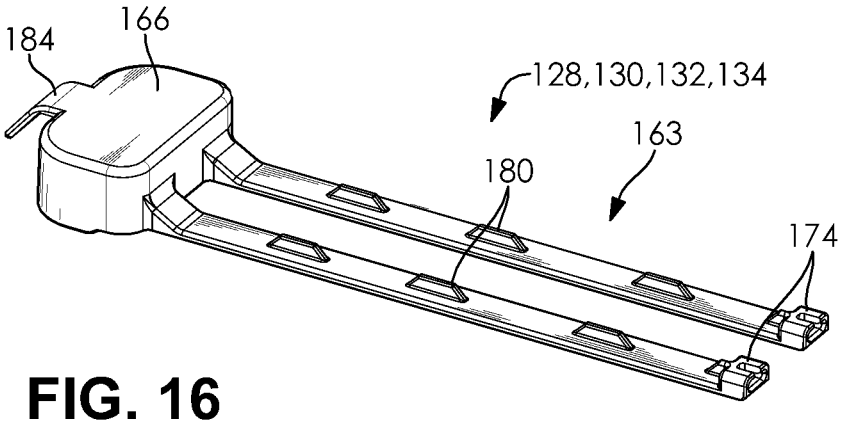
FIG. 16 is a bottom perspective view of the latch shown in FIG. 15.

Referring now to FIGS. 14-16, each of the four latching mechanisms 128, 130, 132, 134 may include a main body 163 that has a handle 166 with a spring 184. The spring 184 is in intimate contact or otherwise connected with the handle 166. For example, the spring 184 may be located on a side of the handle 166 and oriented toward a center area of its respective side panel 102, 104 where installed in the side panel 102, 104. Each of the latching mechanisms 128, 130, 132, 134 may further comprise at least one slide extension 168 that is in intimate contact or otherwise connected with the handle 166. The at least one slide extension 168 is located on a side of the handle 166 and extends away therefrom, for example, toward respective corners 150, 152, 154, 156 of the foldable crate 100 upon being installed.

In the first embodiment, as also shown in FIGS. 14-16, a cup 170 may be disposed at the end of each of the slide extensions 168. The cup 170 may be configured to receive a mating post 178 of the front and rear panels 106, 108, as shown in FIG. 14, to selectively engage with the front and rear panels 106, 108 to selectively hold the side panels 102, 104 in the unfolded position. FIG. 16 also shows that, on an interior side of each slide extension 168, there is a series of bumps 180. These bumps 180 are configured to slide over and against ribs 182 (shown in FIG. 14) within the side panels 102, 104 and provide both a slight resistant to movement and to provide the user with a tactile indication of the movement from an engaged position to a disengaged position in operation. As further seen in FIG. 16, each cup 170 may have a groove 174 formed in an end thereof, which facilitates the receipt of the mating post 178 in operation.

It should be appreciated that FIG. 14 illustrates further details of the first embodiment of the latching mechanisms 128, 130, 132, 134, which are movable between a normal engaged position and a disengaged position. The latching mechanisms are shown in FIG. 14 in the engaged position and selectively holding the side panels 104, 106 in a substantially vertical orientation in the unfolded position. The springs 184 apply a biasing force on the latching mechanisms 128, 130, 132, 134 to normally hold the main bodies 163 in the engaged position. In the engaged position, the groove 174 in the cup 170 becomes aligned with the mating post 178 on the front panel 106. Where the biasing force is overcome by a manual gripping of the handles 166, the cup 170 moves to a disengaged position and is spaced apart from the mating post 178. In the disengaged position, the user moves the handle 166 to cause the main bodies 163 to move back toward the center of the side panel 104, the spring 184 becomes compressed a rib 182. In turn, this movement allows the front panel 106 to be disconnected from the left side panel 104.

It should also be understood that, where the force is applied to the handle 166, the bumps 180 move toward the center of the side panels 102, 104. Due to their placement along the slide extensions 168, the bumps 180 rub against the internal ribs 182 of the foldable crate 100. The bumps 180 thereby facilitate manual lateral movement of the slide extensions 168 during compression and decompression of the spring 184, in operation.

Figure 18:
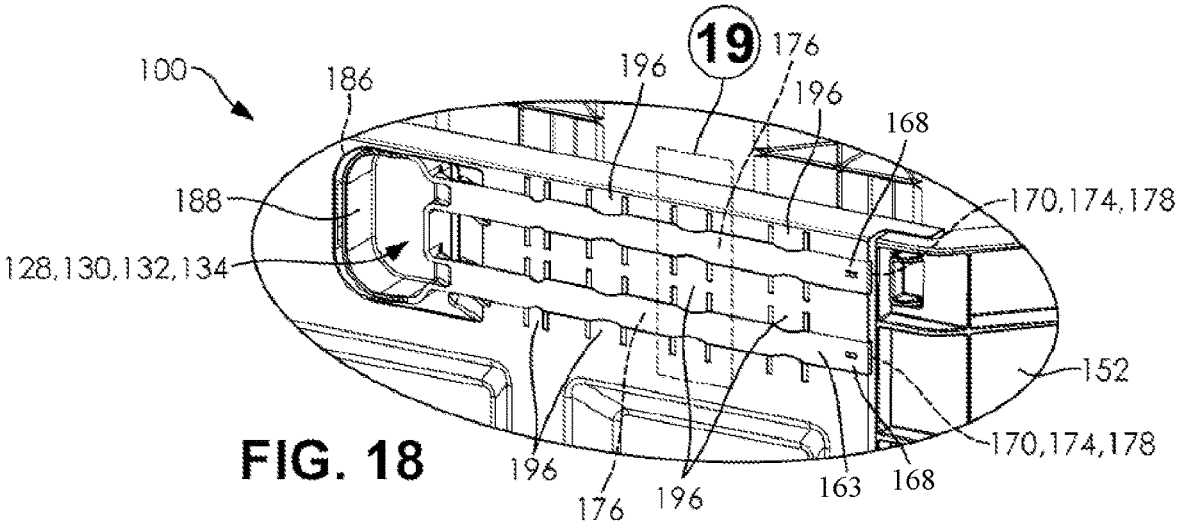
FIG. 18 is an enlarged fragmentary side perspective view of a foldable crate shown according to a further embodiment of the disclosure, and showing a second embodiment of a latching mechanism disposed therein.
Figure 19:
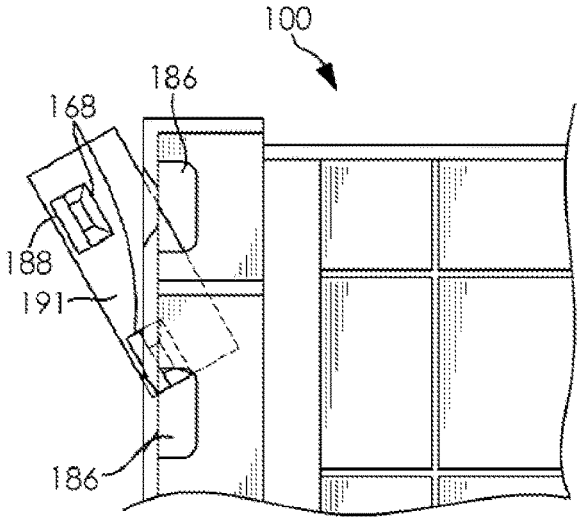
FIG. 19 is an enlarged fragmentary front elevational view of the foldable crate taken at call out 19 in FIG. 18, and showing the latching mechanism in a first position of a method of inserting the latching mechanism into the foldable crate.
Figure 20:
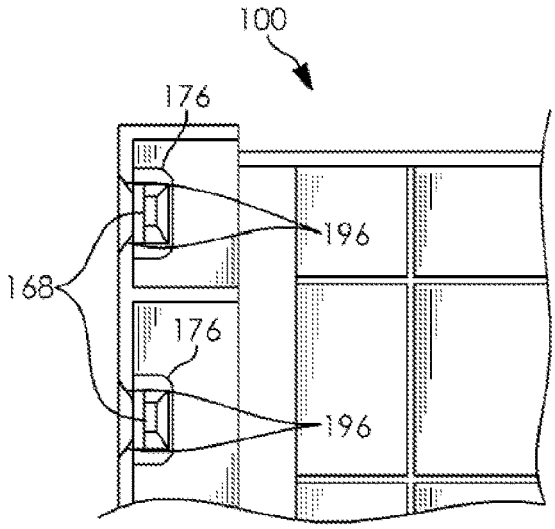
FIG. 20 is an enlarged fragmentary front elevational view of the foldable crate taken at call out 19 in FIG. 18, and showing the latching mechanism in a second position of a method of inserting the latching mechanism into the foldable crate.

The latching mechanisms 128, 130, 132, 134 according to a second embodiment of the disclosure are illustrated in FIGS. 18-20. As with the first embodiment, the latching mechanisms 128, 130, 132, 134 of the second embodiment provide selective latching and releasing of the panels 102, 104, 106, 108. The second embodiment utilizes the main body 163 for selectively engaging and disengaging between the side panel 104 and the front panel 106, which also applies to all four corners 150, 152, 154, 156 of the foldable crate 100.

Where all of the panels 102, 104, 106, 108 are in the unfolded position, it should be appreciated that the panels 104, 106 may be vertically aligned and selectively interlocked in place. Where the user chooses to fold the foldable crate 100 to the folded position, the user grips and applies force to the handle 166 of the latching mechanism 128, 130, 132, 134, consequently moving the associated main body 163 toward the center of the side panel 104, while simultaneously compressing the spring 184 against a portion of the side panel 104 on an inside of the respective left or right side panel 102, 104. This results in a release of the side panel 104 from the front left corner of the front panel 106, wherein the groove 174 is pulled away from the post 178. This action releases the left side panel 104 from the front panel 106 to allow for the folding of the foldable crate 100 to the folded position.

Hence, it should be appreciated that the second embodiment shown in FIGS. 18-20 functions similarly to that described above for the first embodiment shown in FIGS. 1-16. However, in the second embodiment, the main body 163 of the latching mechanism 128, 130, 132, 134 is installed from the exterior 159 of the left or right side panels 104, 106 rather than being molded in place within the left or right side panels 104, 106 as described hereinabove with the first embodiment.

Specifically, as shown in FIGS. 19-20, for the second embodiment the main body 163 of each of the latching mechanisms 128, 130, 132, 134 is installed into the side panels 102, 104 by way of an exterior 159 of the foldable crate 100. In particular the latching mechanism 128, 130, 132, 134 are inserted through an open face of the side panels 102, 104 and pushed past angled clips 196. The angled clips 196 may have beveled exterior edges that permit the latching mechanism 128, 130, 132, 134 to be slid past the clips 196, but otherwise hold the latching mechanism 128, 130, 132, 134 in place while permitting for a lateral sliding movement in operation.

As shown in FIGS. 19-20, the slide extensions 168 of the latching mechanism 128, 130, 132, 134 slide in from a handle recess 186 formed in the outer surface of the side panels 102, 104. They are pushed or slid past the angled clips 196. The slide extensions 168 are then slid to where the cups 170, with the grooves 174 thereon, are aligned to mate with corresponding posts 178, as described hereinabove with respect to the first embodiment as well. In other words, the slide extensions 168 are disposed along the side panels 102, 104 from the handle recess 186 (see FIG. 19), into a slide recess 176, and behind the opposing angled clips 196, so as to allow the cup and groove 170, 174 at the ends of the slide extensions 168 to accept the posts 178, for example, located at the corner 152 of the front panel 106.

The latching mechanisms 128, 130, 132, 134 according to a third embodiment of the disclosure are illustrated in FIGS. 21-24. In contrast to the first embodiment (shown in FIGS. 1-16) and the second embodiments (shown in FIGS. 18-20), the third embodiment utilizes the main body 188 with a single slid extension 168 and without a cup 170 or a groove 174 for selectively engaging or disengaging with the corners 150, 152, 154, 156 of the front and rear panels 106, 108. The latching mechanism 128, 130, 132, 134 of the third embodiment is particularly a unitary one-piece structure that spans an opening between alternating flat and beveled clips 198, 200, as opposed to the two separate slide extensions 168 that are shown and described with respect to the first and second embodiments of the disclosure.

Figure 22:
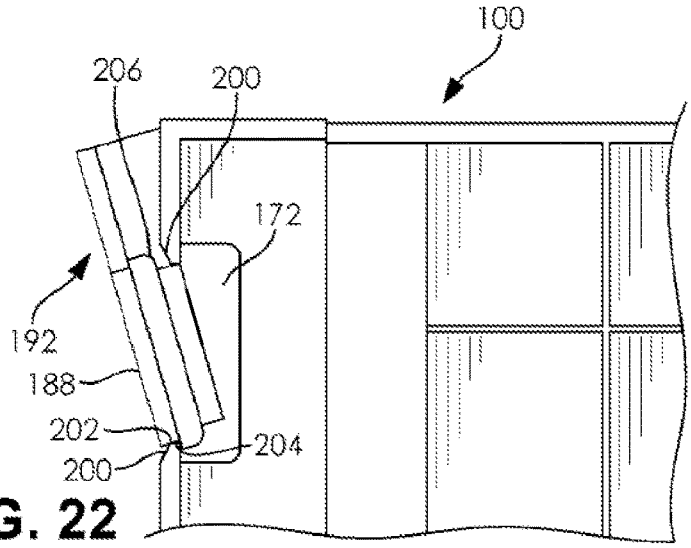
FIG. 22 is an enlarged fragmentary front elevational view of the foldable crate taken at call out 22 in FIG. 21, and showing the latching mechanism in a first position of a method of inserting the latching mechanism into the foldable crate.

In the third embodiment, instead of sliding the main body 188 into place behind the upper flat and bevel clips 198, 200 and the lower flat and bevel clips 198, 200, the main body 188 is conveniently "snapped" into place, as shown in FIGS. 22 and 23. This placement is made possible by placing lower front faces 202 of the main body 188 on top edges 204 of the lower bevel clips 200, as shown in FIG. 22, and then pivoting the top of the latching mechanism 128, 130, 132, 134 forward, as shown in FIG. 23. In these positions, the upper rounded portion 206 of the main body 188 clears the bottom edges of the upper bevel clips 200, by pushing the main body 188 inward. Thereby, the upper rounded portion 206 of the main body 188 clears the upper bevel clips' beveled edges, as shown in FIG. 23. Consequently, the main body 188 is "snapped" into a sliding position within the foldable crate 100.

It should be appreciated that, since the upper and lower flat clips 198 are shorter than their associated beveled clips 200, the flat clips 198 do not interfere with the installation of the main body 188 of the latching mechanism 128, 130, 132, 134. Even though the upper and lower flat clips 198 may be relatively shorter, these flat clips 198 provide additional guidance for the main body 188 as the latching mechanisms 128, 130, 132, 134 are engaged and disengaged in operation, to facilitate placement of the foldable crate 100 in one of the folded position and the unfolded position.

For the third embodiment, where all the panels 102, 104, 106, 108 are in the unfolded position, the side panels 102, 104 may be vertically aligned and interlocked in place. When the user chooses to fold the foldable crate 100 to the folded position, a force is applied to each of the handles 189 of the latching mechanisms 128, 130, 132, 134. Consequently, the main bodies 188 move toward the center of the side panel 102, 104, while the springs 184 become compressed against an associated portion of the side panel 102, 104. This, for example, releases the side panel 102, 104 from the front left corner of the front panel 106, wherein an end finger 195 of the of the second latch 188 moves away from a flat end area 197 of the front panel 106 (see FIG. 24, which is a magnified view of FIG. 21 showing the bevel on the clips). This movement of the second latch 188 toward the center of the left side panel 104 releases the left side panel 104 from the front panel 106 to initiate the folding of the crate 100. Consequently, the third embodiment 192 results in a release of the left side panel 104 from the front panel 106. It should also be appreciated that, in the third embodiment, the main body 188 may more stably hold the side panels 102, 104 in place in the unfolded position, as opposed to the first and second embodiments that require the alignment of the cup 170 and the groove 174 with the post 178 on the front panel 106.

A method of installing the latching mechanisms 128, 130, 132, 134 of the third embodiment within the foldable crate 100 is shown in FIGS. 22-23, and involves placing a front face lower edge 202 of the main body 188 onto a series of top edges 204 of the lower bevel clips 200, which are formed in the left side panel 104. This step applies equally to the right side panel 102. Then, an inwardly directed force is applied on the top of the front face of the latch 188. This force is directed toward a second latch recess 176, within the left side panel 106 of the foldable crate 100. Consequently, an upper rounded edge 206 of a rear portion of the latch 188 contacts the series of bevel clips 200 that are capable of bending inwardly. With the force being applied, the series of upper bevel clips 200 bend inwardly until the upper rounded edge of the rear portion of the latch is within a second slide recess 172. Thereby, the front portion of the latch 188 is placed in vertical alignment with the exterior 159 of the left side panel 106, a rear portion of the latch 188 is placed within the second slide recess 172, the handle 189 is placed within the handle recess, and the spring 184 is placed in the spring recess 185.

Advantageously, the folding crate 100 of the present disclosure has been found to conserves floor and vertical space during shipping and storage, due the compact nature of the folded position of the folding crate 100.

While certain representative embodiments and details have been shown for purposes of illustrating the invention, it will be apparent to those skilled in the art that various changes may be made without departing from the scope of the disclosure, which is further described in the following appended claims.

What is claimed is:

1. A foldable crate, comprising:

a bottom panel, a left side panel, a right side panel, a front panel, and a rear panel, each of the left side panel, the right side panel, the front panel, and the rear panel being hingedly attached to the bottom panel and movable between a folded position and an unfolded position, at least one latching mechanism disposed in one of the left side panel and the right side panel and configured to be manually moved from an engaged position to a disengaged position, and the latching mechanism configured to selectively interlock one of the left side panel and the right side panel with one of the front panel and the rear panel where one of the left side panel and the right side panel are in the unfolded position and the latching mechanism is in the engaged position, wherein the latching mechanism includes a main body having a handle with a spring and at least one slide extension with an end portion, the spring contacting an area of one of the left side panel and the right side panel and normally biasing the latching mechanism in the engaged position, the spring further permitted to be manually compressed upon movement of the latching mechanism to the disengaged position, and the end portion of the at least one slide extension is configured to selectively interact with one of the front panel and the rear panel where the one of the left side panel and the right side panel are in the unfolded position and the latching mechanism is in the engaged position.

2. The foldable crate of claim 1, wherein the at least one slide extension includes a single, one-piece slide extension.

3. The foldable crate of claim 2, wherein the end portion of the single, one piece slide extension is blunt.

4. The foldable crate of claim 3, wherein each of the front panel and the rear panel has corners, and each of the corners includes a recess disposed between a pair or parallel ribs, and the recess is configured to receive the blunt end of the at least one slide extension where in the engaged position and to not receive the blunt end of the at least one slide extension in the disengaged position, one of the left side panel and the right side panel interlocked with one of the front panel and the rear panel where the left side panel, the right side panel, the front panel, and the rear panel are in the unfolded position and the blunt end of the latching mechanism is in the engaged position.

5. The foldable crate of claim 1, wherein the at least one latching mechanism includes a first pair of latching mechanisms and a second pair of latching mechanisms, the first pair of latching mechanisms oriented in opposite directions relative to each other within the left side panel and the second pair of latching mechanisms oriented in opposite directions relative to each other within the right side panel.

6. The foldable crate of claim 1, wherein each of the left side panel and the right side panel have exterior and interior ribs formed thereon.

7. The foldable crate of claim 1, wherein an outer surface of one of the left side panel and the right side panel has a recess formed therein that receives the latching mechanism.

8. The foldable crate of claim 7, wherein a perimeter of the recess has a plurality of clips configured to slidably secure the latching mechanism within the recess.

9. The foldable crate of claim 8, wherein the clips including a plurality of upper clips and a plurality of lower clips, the upper clips spaced apart from the lower clips.

10. The foldable crate of claim 9, wherein each of the upper clips and the lower clips include flat clips and beveled clips.

11. The foldable crate of claim 10, wherein the flat clips and the beveled clips are arranged in an alternating fashion along the perimeter of the recess.

12. The foldable create of claim 11, wherein each of the beveled clips has a beveled outer surface, the beveled outer surface permitting for the latching mechanism to be snapped into the recess past the beveled clips during an installation of the latching mechanism.

13. The foldable crate of claim 1, wherein the spring is disposed on a first side of the handle and the at least one slide extension is disposed on a second side of the handle, the first side disposed opposite the second side.

14. The foldable crate of claim 13, where the spring, the handle, and the at least one slide extension is formed as a single, one-piece unit.

15. The foldable crate of claim 14, wherein the single, one-piece unit is molded plastic.

16. The foldable crate of claim 15, wherein the spring is defined by a tab extending outwardly from the handle and oriented an angle relative to a bottom surface of the handle.

17. The foldable crate of claim 16, wherein the handle is defined by a hand-sized cup element disposed between the spring and the at least one slide extension.

18. The foldable crate of claim 1, wherein the end portion of the slide extension has a cup and one of the front panel and the rear panel has a post, the cup configured to receive the post where the latching mechanism is in the engaged position and the one of the front panel and the rear panel is in the unfolded position.

19. A foldable crate, comprising:

a bottom panel, a left side panel, a right side panel, a front panel, and a rear panel, each of the left side panel, the right side panel, the front panel, and the rear panel being hingedly attached to the bottom panel and movable between a folded position and an unfolded position, at least one latching mechanism disposed in one of the left side panel and the right side panel and configured to be manually moved from an engaged position to a disengaged position, and the latching mechanism configured to selectively interlock one of the left side panel and the right side panel with one of the front panel and the rear panel where one of the left side panel and the right side panel are in the unfolded position and the latching mechanism is in the engaged position, wherein the latching mechanism includes a main body having a handle with a spring and at least one slide extension with an end portion, the spring contacting an area of one of the left side panel and the right side panel and normally biasing the latching mechanism in the engaged position, the spring further permitted to be manually compressed upon movement of the latching mechanism to the disengaged position, and the end portion of the at least one slide extension is configured to selectively interact with one of the front panel and the rear panel where the one of the left side panel and the right side panel are in the unfolded position and the latching mechanism is in the engaged position, wherein the at least one slide extension includes a single, one-piece slide extension, and the end portion of the single, one piece slide extension is blunt, and each of the front panel and the rear panel has corners, and each of the corners includes a recess disposed between a pair or parallel ribs, and the recess is configured to receive the blunt end of the at least one slide extension where in the engaged position and to not receive the blunt end of the at least one slide extension in the disengaged position, one of the left side panel and the right side panel interlocked with one of the front panel and the rear panel where the left side panel, the right side panel, the front panel, and the rear panel are in the unfolded position and the blunt end of the latching mechanism is in the engaged position, and wherein an outer surface of one of the left side panel and the right side panel has a recess formed therein that receives the latching mechanism, perimeter of the recess has a plurality of clips configured to slidably secure the latching mechanism within the recess, the clips including a plurality of upper clips and a plurality of lower clips, the upper clips spaced apart from the lower clips, each of the upper clips and the lower clips include flat clips and beveled clips, the flat clips and the beveled clips are arranged in an alternating fashion along the perimeter of the recess, and each of the beveled clips has a beveled outer surface, the beveled outer surface permitting for the latching mechanism to be snapped into the recess past the beveled clips during an installation of the latching mechanism.

20. A foldable crate, comprising:

a bottom panel, a left side panel, a right side panel, a front panel, and a rear panel, each of the left side panel, the right side panel, the front panel, and the rear panel being hingedly attached to the bottom panel and movable between a folded position and an unfolded position, a first pair of latching mechanisms and a second pair of latching mechanisms, the first pair of latching mechanisms oriented in opposite directions relative to each other within the left side panel and the second pair of latching mechanisms oriented in opposite directions relative to each other within the right side panel, and each of the latching mechanisms configured to be manually moved from an engaged position to a disengaged position, and the latching mechanisms configured to selectively interlock one of the left side panel and the right side panel with one of the front panel and the rear panel where one of the left side panel and the right side panel are in the unfolded position and the latching mechanism is in the engaged position, wherein each of the latching mechanisms includes a main body having a handle with a spring and at least one slide extension with an end portion, the spring contacting an area of one of the left side panel and the right side panel and normally biasing the latching mechanism in the engaged position, the spring further permitted to be manually compressed upon movement of the latching mechanism to the disengaged position, and the end portion of the at least one slide extension is configured to selectively interact with one of the front panel and the rear panel where the one of the left side panel and the right side panel are in the unfolded position and the latching mechanism is in the engaged position, wherein the spring is disposed on a first side of the handle and the at least one slide extension is disposed on a second side of the handle, the first side disposed opposite the second side, the spring is defined by a tab extending outwardly from the handle and oriented an angle relative to a bottom surface of the handle, and the handle is defined by a hand-sized cup element disposed between the spring and the at least one slide extension.

* * * * *